US005366320A

United States Patent [19]

Hanlon et al.

[11] Patent Number: 5,366,320

[45] Date of Patent: Nov. 22, 1994

[54] SCREED FOR PAVING MACHINES

[76] Inventors: Brian G. Hanlon, 51 Winding Way; Lawrence C. Hanlon, 33 Haskell Ave., both of South Portland, Me. 04106

[21] Appl. No.: 133,568

[22] Filed: Oct. 8, 1993

Related U.S. Application Data

[63] Continuation-in-part of Ser. No. 41,131, Mar. 31, 1993, abandoned, which is a continuation of Ser. No. 810,851, Dec. 20, 1991, abandoned.

[51] Int. Cl.[5] ..... E01C 19/22

[52] U.S. Cl. ..... 404/118; 404/96

[58] Field of Search ..... 404/83, 118–120, 404/96; 423/439–440; 51/307–309; 148/325; 420/34, 580

[56] References Cited

U.S. PATENT DOCUMENTS

| | | | |
|---|---|---|---|
| 3,673,930 | 7/1972 | Britchet | 404/119 |
| 3,702,578 | 11/1972 | Davin | 404/118 |
| 4,400,212 | 8/1983 | Ray et al. | 148/403 |
| 4,723,869 | 2/1988 | Dragich | 404/118 X |
| 4,865,487 | 9/1989 | Lutz | 404/118 |
| 4,925,341 | 5/1990 | Neal | 404/118 X |
| 4,954,073 | 7/1990 | Dubensky et al. | 51/307 |
| 4,985,092 | 1/1991 | Kaede et al. | 148/325 X |

*Primary Examiner*—Peter R. Brown

*Assistant Examiner*—Nancy Mulcare

*Attorney, Agent, or Firm*—William B. Ritchie

[57] ABSTRACT

An improved screed for leveling abrasive paving material on a road surface. The improved screed is attachable to a typical road paving machine using standard mounting assembly and attachment components. The improved screed is highly abrasion-resistant and loses much less heat during shutdown periods than steel screeds because it is formed of a composite that includes a chromium-carbide alloy. The composite is formed of a relatively soft metal that is essentially completely fused to the chromium-carbide alloy. The highly abrasion-resistant alloy, which has a Brinell hardness in the range 550 to 600 and a low coefficient of friction, comes in direct contact with the abrasive paving material and its low thermal conductivity permits it to retain heat during shutdown. The relatively soft metal, which may be low-carbon steel, provides an easy and reliable surface for affixing standard attachment components, such as bolts to the improved screed, thereby providing an effective means for mounting to the paving machine. A curved leading edge of the screed prevents the paving material from welling up on the relatively soft metal upper surface of the improved screed. The curved leading edge is formed of the same composite as the rest of the screed.

10 Claims, 4 Drawing Sheets

SCREED FOR PAVING MACHINES

This application is a continuation-in-part of Ser. No. 08/041,131, filed Mar. 31, 1993, now abandoned, which is a continuation of Ser. No. 07/81 0,851, filed Dec. 20, 1991, now abandoned.

BACKGROUND OF THE INVENTION

1. Field of the Invention

The present invention relates to an improved screed for use on street paving machines. More particularly, the present invention relates to a screed that has a long-term service life, that retains heat for an extended period of time, and that is readily affixable to standard paving equipment. The present invention is an improved screed formed of a chromium-carbide composition alloy for extremely high wear-resistance and low thermal conductivity, with a low-carbon steel cladding to provide reliable screed-to-paver attachment.

2. Description of the Prior Art

In the road construction industry, the paving machine is the most commonly used piece of equipment for placing paving material onto a graded underlying surface. The paving machine comprises, among many other components, a screed. The screed provides an initial mechanism for leveling hot, relatively soft material, such as asphalt, deposited on the underlying surface by the paving machine. The screed has an essentially smooth bottom surface contacting the paving material and is affixed to structural members of the paving machine by its top surface. In operation, the paving material is first deposited by the machine as the machine travels along a predetermined path. The screed is affixed to the paving machine at a point behind the opening through which the paving material is deposited, and is drawn over the deposited material to create a relatively smooth, level surface before the hot material cools and hardens. It is necessary to keep the screed temperature at or near the temperature of the hot paving material in order to prevent the material from sticking to the screed as the screed passes over and contacts it.

Screeds are as well known in this field as the paving machines themselves. Modifications in their design have primarily been related to dimensional restrictions. In particular, the patents issued to Birtchet (U.S. Pat. No. 3,673,930) and Davin (U.S. Pat. No. 3,702,578) disclose means for adding extensions in order to increase the operational width of the paving machine. Davin specifically provides a means for extending the screed length in a short period of time. Such a goal is of considerable importance in this labor-intensive industry for it is well known that time spent waiting for equipment to be modified, or for equipment to reach its operating parameters, is lost time.

One other improved screed, related to the present invention, is disclosed in the patent issued to Lutz (U.S. Pat. No. 4,865,487). Lutz describes the need to provide a paving screed that has a high-wear-resistant bottom plate. This is achieved by fabricating the bottom plate of steel with a hardness in the Brinell range of about 450–500. Most conventional paving machines utilize a mild steel screed, Brinell hardness in the range 150–200, that must be replaced in a relatively short period of time, due to the abrasiveness of the paving material and the underlying surface. On the other hand, the hard steel used by Lutz is believed to extend the service life of the screed considerably. Furthermore, Lutz provides curved leading and trailing edges, formed of low-carbon steel that is welded to the flat hard steel screed, that make the screed reversible for even greater service life.

While the screed described by Lutz is theoretically better than the mild steel screeds used previously in that it provides better wear resistance, there are several deficiencies that make it unsuitable for actual use. Of notable concern is that the entire screed—except for edge ad-ons—is fabricated of the hard steel. Threaded bolts, used to attach the screed to a mounting assembly, must be affixed to the top surface of the screed—that is, the surface nearest the mounting assembly and farthest from the deposited paving material. Although the bolts are typically made of mild steel, Lutz notes that stainless steel bolts may also be used. The most effective and reliable means for attaching the bolts is by welding them to the top screed surface. However, welding a dissimilar metal to the hard steel in a localized area is extremely difficult and often results in severe degradation of the hard steel in that localized area. This degradation is most readily observed when the bolts are torqued to secure the screed to the mounting assembly; under the required torque loading the bolts often break away from the hard steel surface. Similar catastrophic failure may result at the interface of the welded leading and trailing edges of the screed described.

Another problem related to the use of hard steel for screeds is the thermal conductivity of steel. As previously indicated, it is necessary to keep the screed temperature at or near the paving material temperature in order to facilitate smooth leveling of the material. This is done by heating the screed using conventional heat transfer means. At the start-up, both the mass of paving material within the paving machine and the screed are heated to operating temperature. This operating temperature varies from one region of the country to another and is a function of the paving material and ambient conditions. Whenever the paving operation is stopped for an extended period of time as, for example, at lunchtime, the machine is shut down. The paving material, with its low thermal conductivity and considerable mass will cool only slightly. However, the steel screed cools much more rapidly. As a result, at the end of a break there is additional down-time caused by the need to bring the screed back up to operating temperature.

Still another problem associated with a hard steel screed is the fact that this material, while an improvement over the mild steel of prior screeds, is still subject to considerable wear. The severity of the environment within which the screed operates and the need to minimize down-time in replacing or reversing screeds requires the use of a material that will withstand particularly difficult abrasion. Therefore, what is needed is an improved screed that is formed of a material that has extremely high wear resistance. What is also needed is an improved screed that is readily adaptable to conventional paver mounting assemblies without catastrophic failure of mounting components. Further, what is needed is an improved screed with relatively low thermal conductivity in order to minimize start-up time after long stoppages.

SUMMARY OF THE INVENTION

In order to overcome the problems associated with prior art screeds it is an objective of the present invention to provide an improved paving screed that has extremely high wear resistance. It is also an objective of the present invention to provide an improved paving screed that is readily adaptable to conventional paver mounting assemblies. Another objective of the present invention is to provide an improved paving screed that is formed of a material with relatively low thermal conductivity in order to minimize start-up time after long stoppages.

The present invention achieves the above-noted objectives by providing an improved screed that is formed of a combination of two dissimilar metals wherein one of the metals forms the bottom surface of the screed and the other forms the top surface of the screed. The metal component forming the bottom surface is extremely hard—in the Brinell range of 550–600—and its thermal conductivity is much less than that of steel. The metal used to form the top surface of the screed is much softer than the bottom surface metal—in the Brinell range of 150–200—and is primarily suitable for welding of conventional attachment elements—such as mild steel mounting bolts.

The key to the present invention is the use of a two-metal composite that is formed by fusing or "mulling" the two dissimilar metals together completely at their interface, rather than tacking them together at intermittent points. Such techniques are well known and fused metal composites are commercially available. The fused composite effectively eliminates the possibility of inter-metal failure by spreading all operational loads over the entire interface, rather than localizing them. The improved screed of the present invention is formed of a fused composite comprising a highly wear-resistant metal, such as a chromium-carbide alloy, and a relatively soft metal, such as mild steel. The chromium-carbide alloy is harder than hardened steel and its thermal conductivity is about one-third to one-half of that of hardened steel. When a chromium-carbide alloy is used as the bottom surface of the improved screed, the screed has a much longer service life than a hardened-steel screed because the wear resistance is greater—even for screeds used to level extremely abrasive paving material, such as the asphalt available in the Northeastern United States. The much lower thermal conductivity of the chromium-carbide alloy results in minimal heat loss when the paving machine is shut down for relatively extended periods of time. Start-up times are therefore shorter when a chromium-carbide alloy is used to form the screed because less time is required to bring the screed up to operating temperature when compared to start-up times for hardened steel screeds.

The mild steel layer of the improved screed, while much softer, has a much greater thermal conductivity than the chromium-carbide underlayer. This works to the advantage of the present invention because the screed heating means of the paving machine is generally affixed to the top surface of the screed. On start-up, heat is quickly transferred to the chromium-carbide layer that will be in contact with the paving material. At shutdown, the slower cooling of the chromium-carbide layer creates an insulative effect, thereby slowing the cooling of the mild steel layer. Another important advantage in the use of the mild steel layer is the compatibility of that metal with the screed mounting components commonly used on paving machines. As previously indicated, the prior art screed formed entirely of hard steel is normally affixed to the screed mounting assembly by bolts or studs made of metals dissimilar to the screed. These bolts and studs are most commonly made of mild, or low-carbon, steel. The improved screed of the present invention avoids catastrophic failure at the screed-to-bolt localized interfaces by using similar metals. That is done by affixing mild steel bolts to the mild steel top screed surface, effectively eliminating such failures.

The improved screed of the present invention may be formed with a curved leading edge of the type described and disclosed by Lutz. However, the curved edge of the present screed is developed by forming the fused composite layer with such curvature rather than welding a mild steel curved edge to the flat portion of the screed. This is particularly important because a considerable build-up of paving material is formed at the leading edge of the screed. This build-up imparts significant stress to the edge of the screed and the dissimilar-metal welded interface of the prior art screed may fail at that interface. Moreover, the mild steel curved edge of the prior screed is subjected to the abrasive action of the paving material and it may degrade long before the hard steel comprising most of the screed. As a result, the service life of the prior screed may be a function of the mild steel curved edge rather than the hard steel portion. The present screed eliminates this problem by forming the screed into the desired shape prior to attachment to the paving machine. The wear-resistant chromium carbide is the only portion of the improved screed that comes in contact with the abrasive paving material. Forming the composite screed of the present invention is easier than forming a screed made entirely of a highly wear-resistant material since a portion of the screed is mild steel, a material more conducive to forming than the much harder metals described herein.

The improved screed of the present invention is formed of a fused composite of a highly wear-resistant metal and a much softer metal wherein the highly wear-resistant metal contacts the abrasive paving material and the softer metal is used to affix the improved screed to the paving equipment. The improved screed provides much longer service life than prior art screeds, it results in shorter down time after relatively long shutdown periods, and it is more readily affixable to standard paving equipment. These and other attributes will become readily apparent upon review of the accompanying drawings and detailed description.

DETAILED DESCRIPTION OF THE INVENTION

Figure 1:
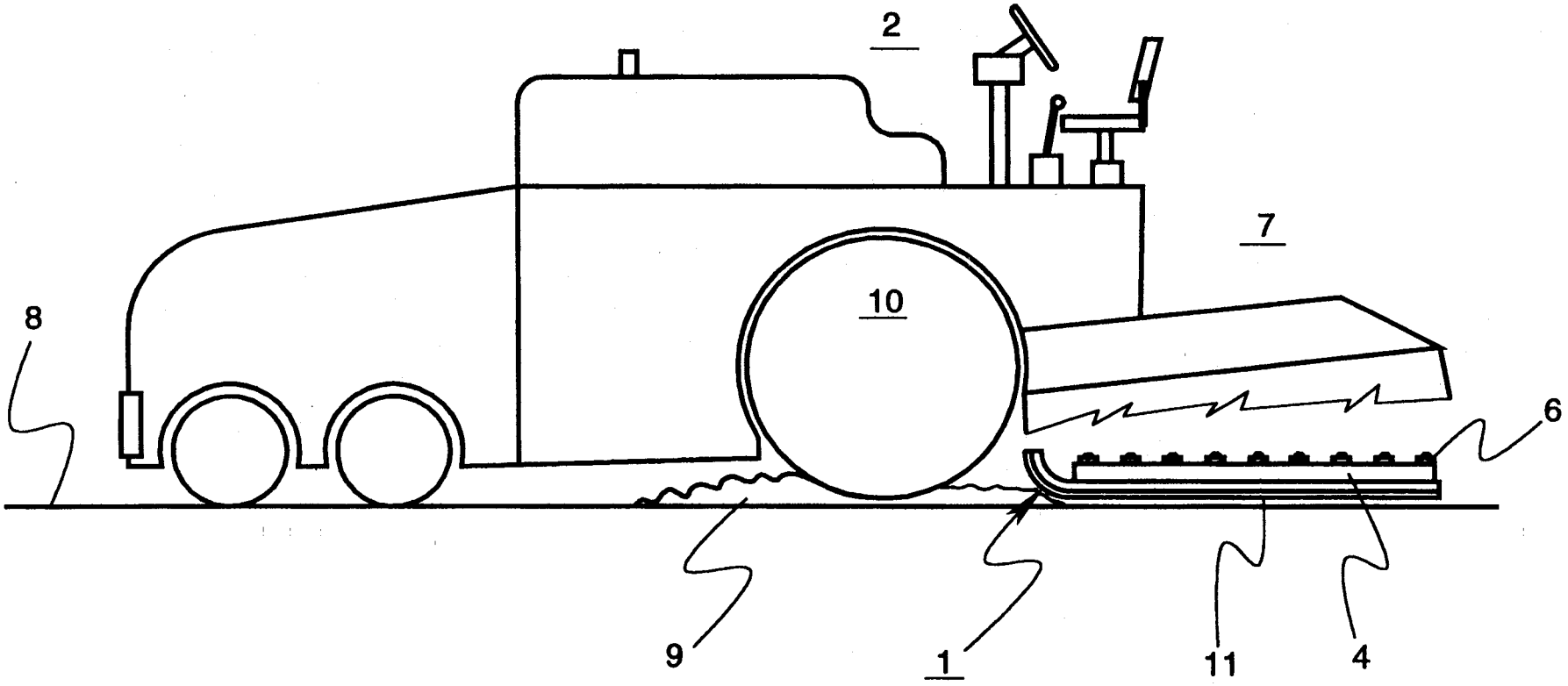
FIG. 1 is a side view of a typical paving machine, including the improved screed of the present invention.
Figure 2:
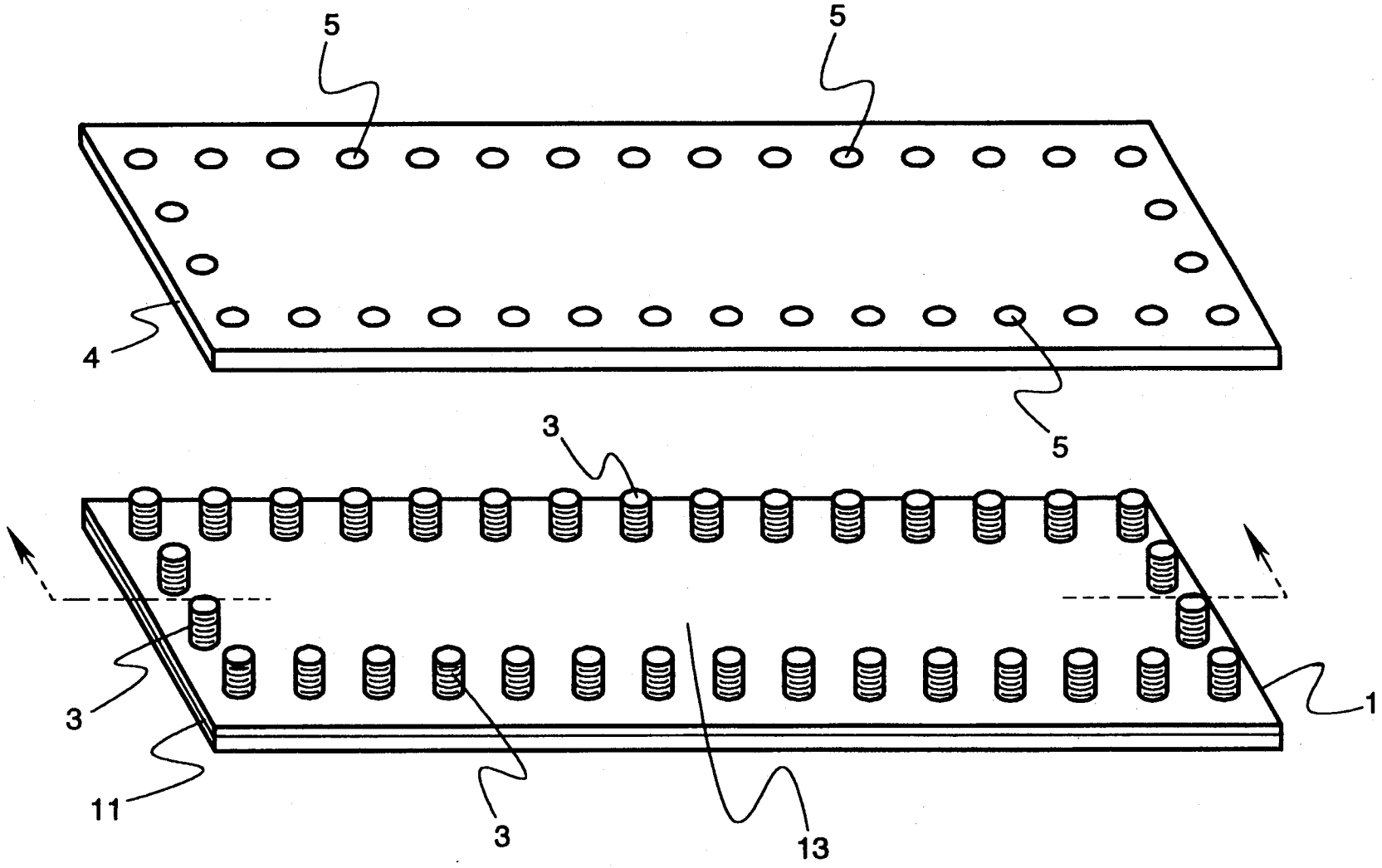
FIG 2. is a perspective view of the improved screed of the present invention, including the mounting bolts for affixing the improved screed to the mounting assembly of a typical paving machine.

Referring to FIGS. 1 and 2, an improved screed 1 of the present invention is shown as attached to a typical road paving machine 2. Said improved screed 1 is affixable to said road paving machine 2 by a plurality of mounting bolts 3, or other suitable means, affixed to a top screed surface 13 of said improved screed 1. Preferably, said mounting bolts 3 are made of a low-carbon, or a mild-weld steel. Said mounting bolts 3 are used to affix said improved screed 1 to said paving machine 2 by way of a paving machine mounting assembly 4 wherein said paving machine mounting assembly 4 comprises a plurality of bolt through-holes 5 for accepting said mounting bolts 3. Although said mounting bolts 3 may be secured within said bolt through-holes 5 of said mounting assembly 4 by any conventional means, in the preferred embodiment of the invention, self-locking nuts 6 are used.

As illustrated in FIG. 1, said improved screed 1 is located at a machine back section 7, near a road surface 8 or the like. Paving material 9, such as asphalt, is first heated, along with said improved screed 1 by conventional heating means, and then transferred from a material storage chamber 10 of said paving machine 2 onto said road surface 8. A bottom screed surface 11 and a leading edge 12 of said improved screed 1 first contact said paving material 9, thereby providing a means of leveling said paving material 9 onto said road surface 8. Said improved screed 1 is preferably about 5' long and about 2' wide, but may be made in a range of sizes.

Figure 3:
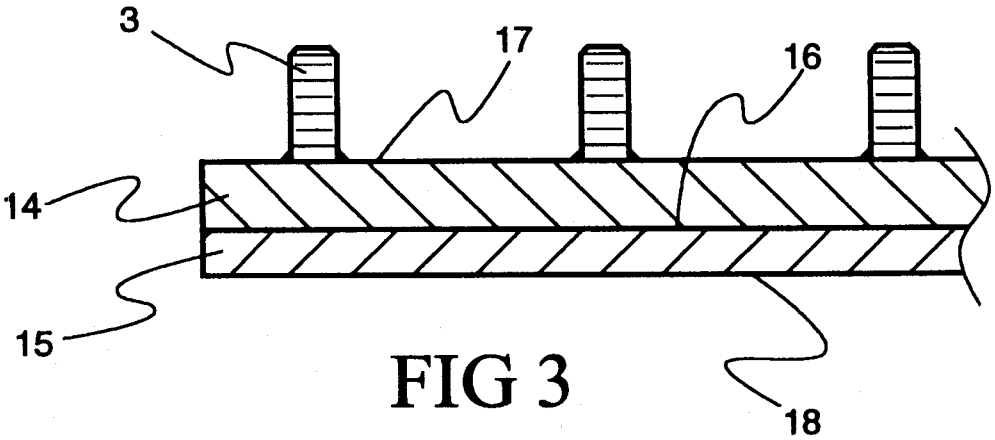
FIG. 3 is a cross-sectional view of the improved screed of the present invention, illustrating the two metals comprising the improved screed.

Referring to FIG. 3, said improved screed 1 comprises a composite of a first metal layer 14 and a second metal layer 15 of dissimilar metals fused together along essentially entirely an inter-metal interface 16 by well known metal fusion or cladding means. Examples of such fused metal materials include ULTRA-MET®, a product of St. Lawrence Steel, and WELLER-CLAD®, a product of The A. J. Weller Corporation. Preferably, said first metal layer 14 is a low-carbon steel with a Brinell hardness of about 150–200 and it is about ¼" thick. Fused to said first metal layer 14 is said second metal 15, preferably a highly wear-resistant metal such as chromium-carbide with a Brinell hardness of about 550–600 and a thermal conductivity that is about one-third to one-half that of steel. Said second metal layer 15 is about ¼" thick. In the preferred embodiment of the present invention, a first metal layer surface 17 of said first metal layer 14 comprises said top screed surface 13, and a second metal layer surface 18 of said second metal layer 15 comprises said bottom screed surface 11.

Because said mounting bolts 3 and said first metal layer 14 are made of low-carbon steel, said mounting bolts 3 may be easily attached to said top screed surface 13 by any conventional means, including welding said mounting bolts 3, or drilling and tapping said first metal layer 14 and inserting said mounting bolts 3. When formed of chromium-carbide, said second metal layer 15 not only provides an extremely hard bottom screed surface 11, it also provides a surface with a lower coefficient of friction than conventional steel products. As a result, said bottom screed surface 11 is more resistant to abrasion by said paving material 9 than prior art screed surfaces because it is both harder and it has a lower coefficient of friction than that metal. Said improved screed 1 comprising a chromium-carbide layer therefore has a much longer service life than prior art screeds. Additionally, the lower thermal conductivity of that metal reduces downtime between paving operations.

Figure 4:
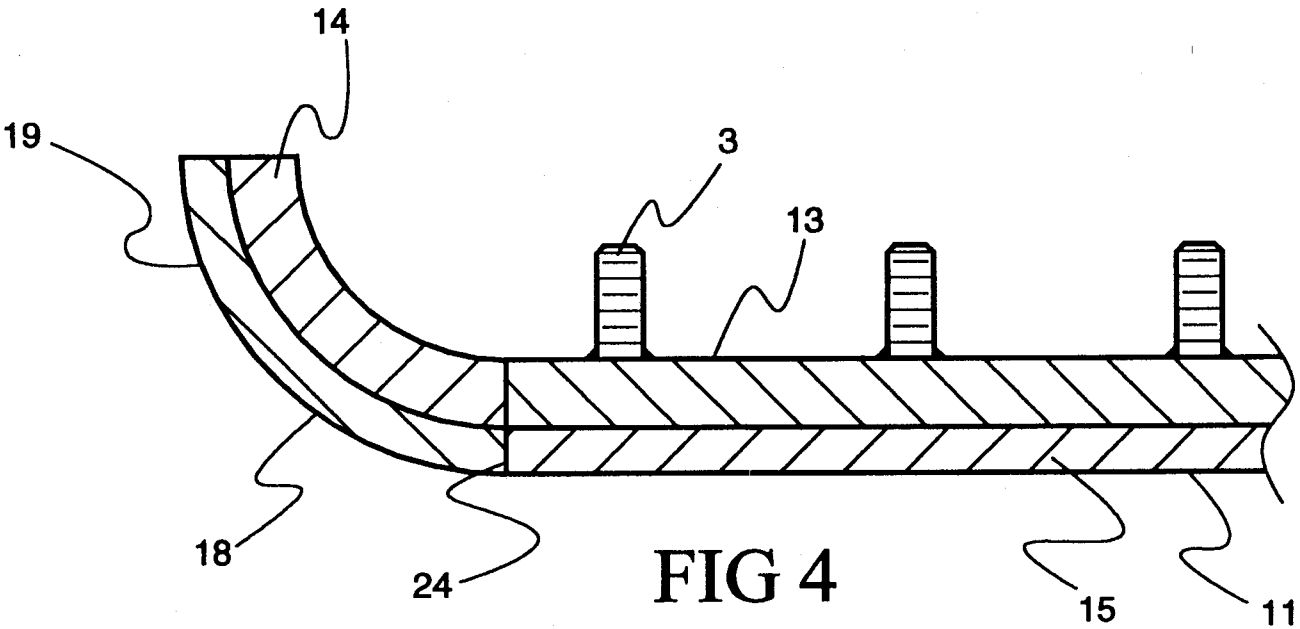
FIG. 4 is a side view of the improved screed of the present invention, including an optional curved leading edge.

In another embodiment of the present invention, said improved screed 1 may also comprise a curved leading edge 19, as illustrated in FIG. 4. Said curved leading ledge 19 further aids in leveling said paving material 9, for as previously noted, when said paving material 9 is deposited onto said road surface 8 from said paving machine 2, a build-up of said paving material 9 is formed at said leading edge 12. This build-up of paving material 9 may push up onto said top screed surface 13. To overcome this problem, said curved leading edge 19 acts as a stop to prevent said paving material 9 from riding onto said top screed surface 13. Preferably, said improved screed 1 comprising said curved leading edge 19 is formed as all one piece, including said first metal layer 14 and said second metal layer 15, wherein said second metal layer surface 18 first contacts said paving material 9, and wherein said curved leading edge 19 is formed along the length dimension of said improved screed 1.

However, leading edge 19 could also be fabricated separately from the main body of screed 1, either as the two piece composite as shown or as a single piece and then welded at line 24. If a two piece composite is selected, the two layers corresponding to edge 19 should identically match or be reasonably close to the metal layers selected for the main body of the screed.

If leading edge 19 is fabricated as a single piece, curved as shown or angled in one or more steps, the hardness of the metal selected could match either layer 14 or layer 15 or be of a different hardness. While the hardness selected will determine the lifespan of the curved leading edge, the bulk of the wear is experienced on the surface of screed that is in contact with paving material. Also, it would then be just a matter of welding on a new leading edge with the remaining part of the screed useable.

Figure 5:
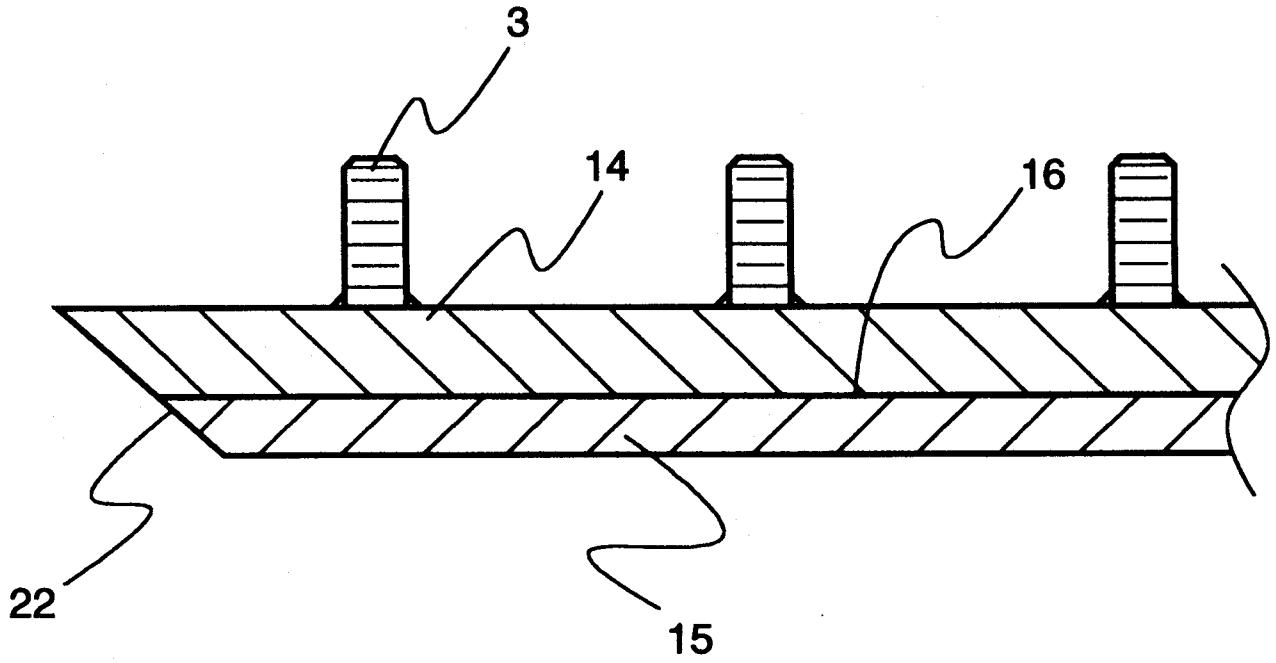
FIG. 5 is an alternative embodiment of the improved screed having an angled leading edge.

In some type of screed equipment, a leading edge as shown in FIG. 4 is not preferred as it is incompatible with the machine. For this type of machine, as shown in FIG. 5, leading edge 22 of screed 1 is preferably angled as shown.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. An screed for leveling paving material, wherein said screed is affixable to a road paving machine, said screed comprising:

a plurality of mounting bolts, with said bolts having a Brinell hardness;

a first metal layer having a leading edge, top and bottom surfaces; said first metal layer having a Brinell hardness corresponding to that of said mounting bolts, wherein said mounting bolts are attached to the top surface of said first metal layer;

a second metal layer having a leading edge, a top and bottom surface and having a Brinell hardness that is substantially harder that the hardness of said first metal layer, said second metal layer being substantially the same size as said first layer, and wherein said first metal layer is joined to said second layer by fusing the bottom metal surface of said first metal layer to the top metal surface of said second metal layer substantially over the entire respective surfaces such that the leading edges of first metal layer and said second metal layer are aligned adjacent to one another.

2. The screed of claim 1 wherein said leading edges of said first metal and second metal are angled, such that when said first metal layer is attached to said second metal layer, said leading edges form an angled plane.

3. The screed of claim 1 further comprising:

a first leading edge layer having a Brinell hardness substantially the same as said first metal layer;

a second leading edge layer having a Brinell hardness substantially the same as said second metal layer;

wherein said first leading edge layer is fused to said second leading edge layer and wherein said first leading edge layer is joined to the leading edge of said first layer; and wherein said second leading edge layer is joined to the leading edge of the said second metal layer.

4. The screed of claim 1 further comprising:

a leading edge attached to the leading edges of said first and second metal layers.

5. The screed of claim 4 with said leading edge layer having a Brinell hardness substantially the same as said first metal layer.

6. The screed of claim 4 with said leading edge layer having a Brinell hardness substantially the same as said second metal layer.

7. The screed of claim 1 wherein said second metal layer is a chromium-carbide alloy.

8. The screed of claim 7 wherein said second metal layer is a low-carbon steel.

9. The screed of claim 8 wherein said chromium-carbide alloy has a Brinell hardness in the range 550–600.

10. The screed of claim 9 wherein said bolts are welded to said first metal layer.

* * * * *